US010203630B2

(12) United States Patent
Yuasa et al.

(10) Patent No.: US 10,203,630 B2
(45) Date of Patent: Feb. 12, 2019

(54) DEVELOPING APPARATUS AND IMAGE FORMING APPARATUS

(71) Applicant: KONICA MINOLTA, INC., Chiyoda-ku, Tokyo (JP)

(72) Inventors: Kei Yuasa, Hino (JP); Shunichi Takaya, Hino (JP); Hideaki Tanaka, Hussa (JP); Kazuteru Ishizuka, Saitama (JP); Shota Sakurai, Machida (JP); Kei Okamura, Yokohama (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/904,753

(22) Filed: Feb. 26, 2018

(65) Prior Publication Data

US 2018/0284644 A1 Oct. 4, 2018

(30) Foreign Application Priority Data

Apr. 4, 2017 (JP) ..... 2017-074643

(51) Int. Cl.

| | |
|---|---|
| ***G03G 15/08*** | (2006.01) |
| ***G03G 9/113*** | (2006.01) |
| ***G03G 21/18*** | (2006.01) |
| ***G03G 15/00*** | (2006.01) |

(52) U.S. Cl.

CPC ..... *G03G 15/0849* (2013.01); *G03G 9/1131* (2013.01); *G03G 15/087* (2013.01); *G03G 15/0812* (2013.01); *G03G 15/6511* (2013.01); *G03G 21/1867* (2013.01)

(58) Field of Classification Search

CPC ..... G03G 15/0891

See application file for complete search history.

(56) References Cited

U.S. PATENT DOCUMENTS

2008/0085137 A1* 4/2008 Suzuki ..... G03G 15/0893 399/254

FOREIGN PATENT DOCUMENTS

| | | |
|---|---|---|
| JP | 50027333 U | 3/1975 |
| JP | 03260678 A | 11/1991 |

* cited by examiner

*Primary Examiner* — Clayton E Laballe
*Assistant Examiner* — Jas Sanghera
(74) *Attorney, Agent, or Firm* — Holtz, Holtz & Volek PC

(57) ABSTRACT

A developing apparatus includes: a developer carrying member carrying a developer; a plurality of developer feeders accommodating the developer carried by the developer carrying member and being arranged in an axial direction of the developer carrying member; and a collecting part that collects the developer from the developer carrying member and feeds the developer to a second developer feeder different from a first developer feeder located at a position where the developer is collected from the developer carrying member in the axial direction, among the plurality of developer feeders.

5 Claims, 7 Drawing Sheets

DEVELOPING APPARATUS AND IMAGE FORMING APPARATUS

The entire disclosure of Japanese patent Application No. 2017-074643, filed on Apr. 4, 2017, is incorporated herein by reference in its entirety.

BACKGROUND

Technological Field

The present invention relates to a developing apparatus and an image forming apparatus.

Description of the Related Art

Generally, an image forming apparatus (printer, copier, facsimile, etc.) utilizing an electrophotographic process technology forms an electrostatic latent image based on image data by emitting laser light (exposure) toward a charged photoconductive drum (image carrier). The image forming apparatus forms a toner image by visualizing the electrostatic latent image by feeding toner from a developing apparatus to the photoconductive drum on which the electrostatic latent image is formed. The toner image is then directly or indirectly transferred to a sheet, and thereafter, the toner image is formed on the sheet by heating, pressurizing and fixing at a fixing nip.

The developing apparatus includes a stirring member for stirring a developer in the developing apparatus. There in a known configuration of the stirring member in which the developer is stirred such that the developer moves in an axial direction of the developing sleeve. In such a configuration, for example, in a case where the size of the developing apparatus is increased in order to cope with a long sheet in the axial direction such as B1 size, the toner is mixed from an upstream side in a moving direction of the developer, and this causes a problem of tendency to increase deviation of toner concentration in the axial direction.

In order to cope with this problem, for example, JP 50-27333 A discloses a configuration of circulating the developer in each of regions on one side and the other half side in the axial direction inside the developing apparatus. FIG. 1 is a simplified diagram illustrating a developing apparatus in a conventional example.

As illustrated in FIG. 1, a developing apparatus 412 includes a developing sleeve 412A and a developer casing 412B. The developer casing 412B includes a first stirring member 412C and a second stirring member 412D that stir the developer in the developer casing 412B.

Each of the first stirring member 412C and the second stirring member 412D has a configuration in which the direction of wings are opposite to each other between a first region B1 on one side and a second region B2 on the other side with respect to a central portion in the axial direction of the developing sleeve 412A. Together with the rotation of the first stirring member 412C and the second stirring member 412D, the developer circulates in the first region B1 and the second region B2 along the flow of arrows B10 and B20, respectively.

In addition, JP 3-260678 A discloses a configuration capable of suppressing an occurrence of a difference in toner concentration between the first region B1 and the second region B2 by actively running the developer in both of the first region B1 and the second region B2 on the boundary between the first region B1 and the second region B2.

A configuration disclosed in JP 50-27333 A, however, might cause a problem that, in the case of continuously forming an image in which a portion corresponding to either one of the first region B1 and the second region B2 includes the extremely large amount of toner than the portion corresponding to the other region, the toner concentration in the portion corresponding to the one extremely decreases, leading to a failure in achieving uniformity in the state of developer in the first region B1 and the second region B2.

In addition, in the configuration described in JP 3-260678 A, in a case where the image is continuously formed, the toner concentration of either one of the first region B1 and the second region B2 extremely decreases, and thus, the other toner concentration decreases due to the decrease in the one. This decreases the toner concentration in the whole developing apparatus from the beginning of image forming processing for the above-described image, leading to an increased time to recover the toner concentration in the whole developing apparatus. In other words, it takes time to uniformize the state of the developer in the first region B1 and the second region B2.

Moreover, in a case where the first region B1 and the second region B2 are divided by partitions, the amount of carrier consumption at a charging failure and the developer deterioration amount generated at continuous formation of an image of low coverage differ between the first region B1 and the second region B2. This leads to difficulty in uniformizing the state of the developer (deviation of the developer amount and the developer deterioration amount) in the first region B1 and the second region B2 in the whole axial direction of the developing apparatus.

SUMMARY

An object of the present invention is to provide a developing apparatus and an image forming apparatus capable of efficiently uniformizing the state of the developer in the whole axial direction of the developing apparatus.

To achieve the abovementioned object, according to an aspect of the present invention, a developing apparatus reflecting one aspect of the present invention comprises:

a developer carrying member carrying a developer;

a plurality of developer feeders accommodating the developer carried by the developer carrying member and being arranged in an axial direction of the developer carrying member; and a collecting part that collects the developer from the developer carrying member and feeds the developer to a second developer feeder different from a first developer feeder located at a position where the developer is collected from the developer carrying member in the axial direction, among the plurality of developer feeders.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Figure 1:
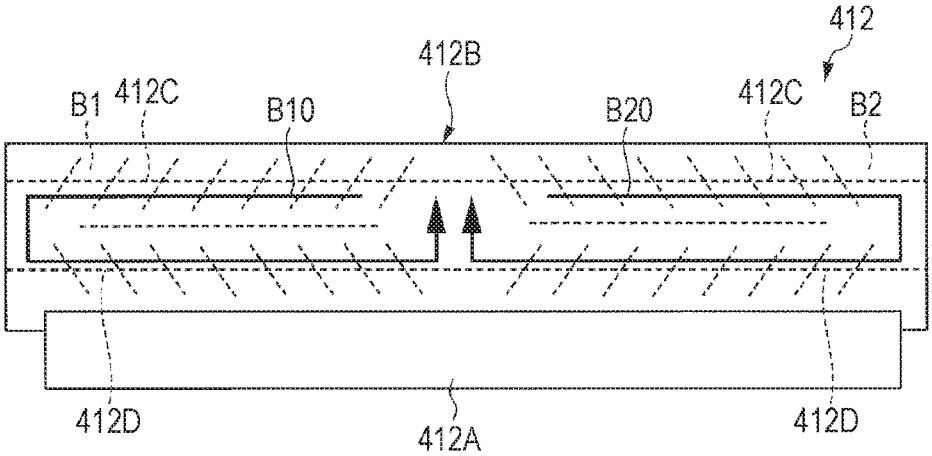
Prior Art FIG. 1
FIG. 1 is a simplified diagram illustrating a developing apparatus in a conventional example.
Figure 2:
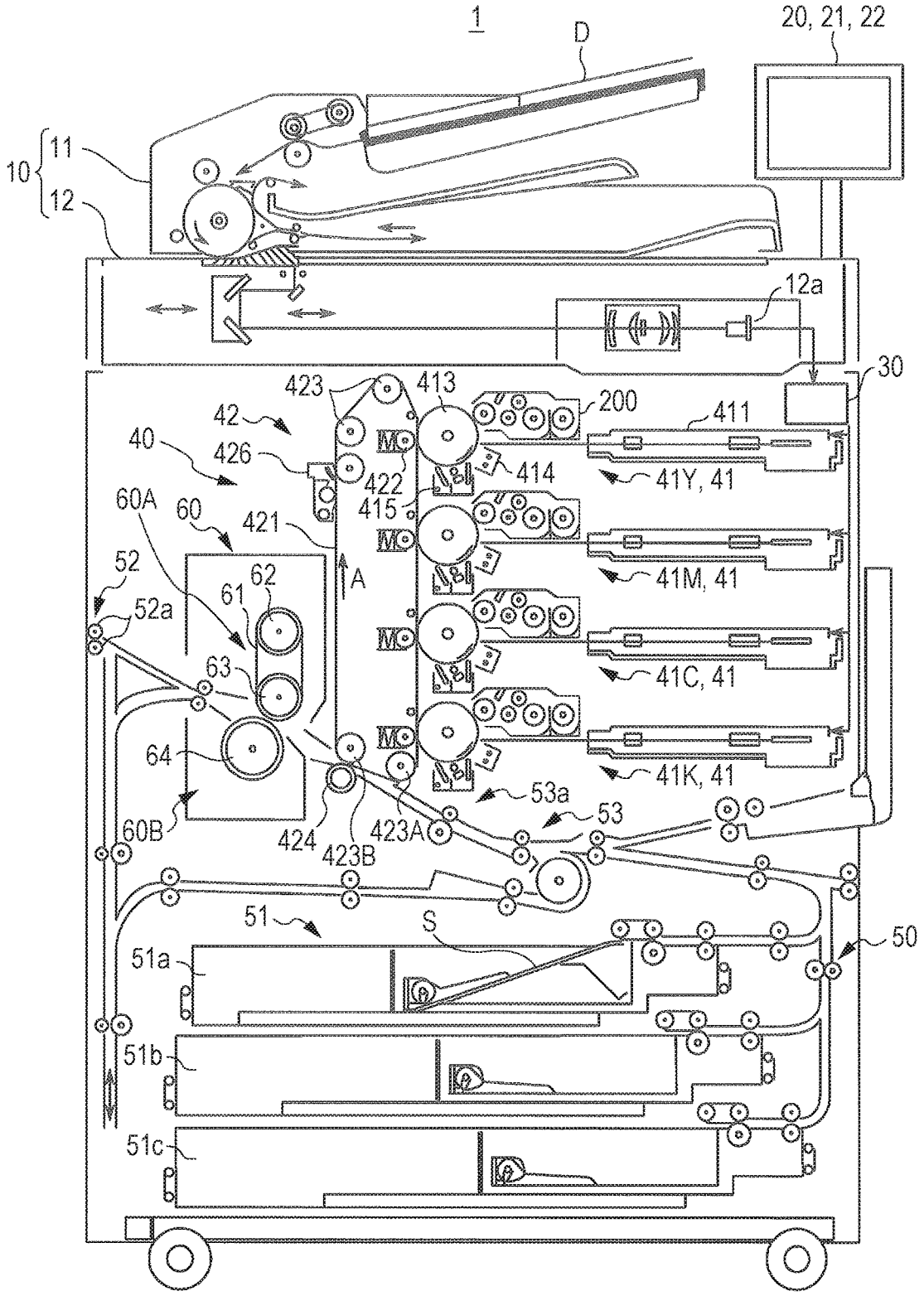
FIG. 2 is a diagram schematically illustrating a whole configuration of an image forming apparatus according to the present embodiment.
Figure 3:
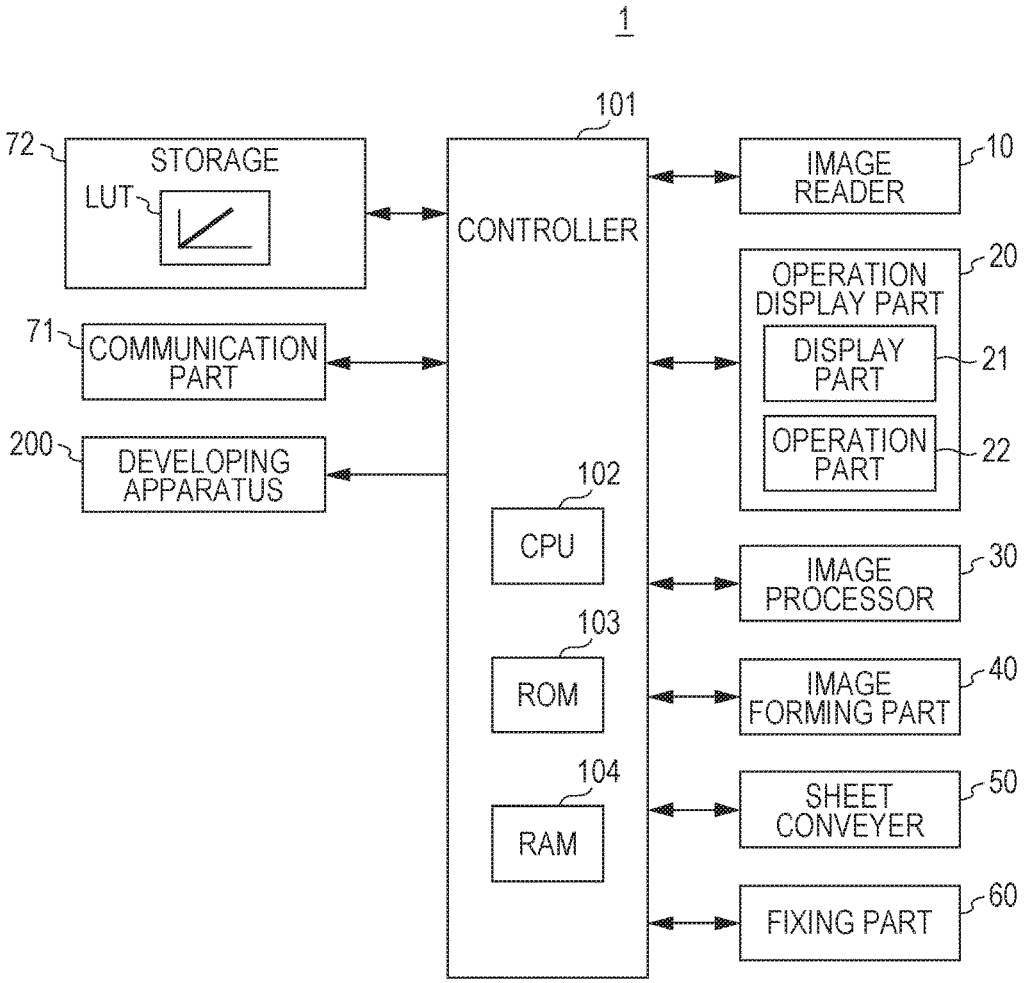
FIG. 3 is a diagram illustrating a main portion of a control system of the image forming apparatus according to the present embodiment.

Hereinafter, one or more embodiments of the present invention will be described in detail with reference to the drawings. However, the scope of the invention is not limited to the disclosed embodiments. FIG. 2 is a diagram schematically illustrating a whole configuration of an image forming apparatus 1 according to the present embodiment. FIG. 3 is a diagram illustrating a main portion of a control system of the image forming apparatus 1 according to the present embodiment.

The image forming apparatus 1 illustrated in FIGS. 2 and 3 is an intermediate transfer system color image forming apparatus utilizing an electrophotographic process technology. Specifically, the image forming apparatus 1 performs primary transfer of toner images of each of colors of yellow (Y), magenta (M), cyan (C), and black (K) formed on a photoconductive drum 413 to an intermediate transfer belt 421, and then, the toner images of the four colors are overlapped with each other on the intermediate transfer belt 421, and then, the toner image secondary-transferred onto a sheet S, thereby forming an image.

The image forming apparatus 1 adopts a tandem system in which the photoconductive drums 413 corresponding to the four colors of Y, M, C, and K are arranged in series in a running direction of the intermediate transfer belt 421, and the toner images of individual colors are sequentially transferred onto the intermediate transfer belt 421 in a single procedure.

The image forming apparatus 1 includes an image reader 10, an operation display part 20, an image processor 30, an image forming part 40, a sheet conveyer 50, a fixing part 60, and a controller 101.

The controller 101 includes a central processing unit (CPU) 102, a read only memory (ROM) 103, and a random access memory (RAM) 104. The CPU 102 reads a program corresponding to processing content from the ROM 103, develops the program in the RAM 104, and centrally controls operation of each of blocks of the image forming apparatus 1 in cooperation with the developed program. At this time, various types of data stored in the storage 72 is referenced. The storage 72 includes, for example, a non-volatile semiconductor memory (or flash memory) and a hard disk drive.

The controller 101 transmits/receives various types of data to/from an external apparatus (for example, a personal computer) connected to a communication network such as a local area network (LAN), a wide area network (WAN) via a communication part 71. For example, the controller 101 receives image data (input image data) transmitted from an external apparatus and allows an image to be formed on the sheet S on the basis of the image data. The communication part 71 includes a communication control card such as a LAN card.

The image reader 10 includes an automatic document feeder (ADF) 11, and a document image scanner (scanner) 12.

The automatic document feeder 11 conveys a document D placed in a document tray by a conveyance mechanism and feeds the document to the document image scanner 12. With the automatic document feeder 11, it is possible to collectively read images (including double-sided image) on a large number of the documents D placed in the document tray.

The document image scanner 12 optically scans a document conveyed onto a contact glass portion from the automatic document feeder 11 or a document placed on the contact glass portion, and reads a document image by focusing reflected light from the document to form an image on a light receiving plane of a charge coupled device (CCD) sensor 12*a*. The image reader 10 generates input image data on the basis of a reading result by the document image scanner 12. The input image data undergoes predetermined image processing in the image processor 30.

The operation display part 20 includes a liquid crystal display (LCD) having a touch panel, for example, and functions as a display part 21 and an operation part 22. According to a display control signal input from the controller 101, the display part 21 displays various operation screens, image condition, individual function operation status, internal information of the image forming apparatus 1, or the like. The operation part 22 includes various operation keys such as a numeric keypad, and a start key, receives various input operation from a user, and outputs an operation signal to the controller 101.

The image processor 30 includes a circuit for performing digital image processing corresponding to initial setting or user setting, on the input image data. For example, the image processor 30 performs tone correction on the basis of tone correction data (tone correction table) under the control of the controller 101. In addition to the tone correction, the image processor 30 applies various types of correction processing such as color correction, shading correction, compression processing, on the input image data. The image forming part 40 is controlled on the basis of the processed image data.

The image forming part 40 includes image forming units 41Y, 41M, 41C, and 41K for forming images with color toners of a Y component, a M component, a C component, and a K component, on the basis of the input image data, and includes an intermediate transfer unit 42.

The image forming units 41Y, 41M, 41C, and 41K for the Y component, the M component, the C component, and the K component have a similar configuration. For the convenience of illustration and explanation, components common with each other are denoted by the same reference sign, and Y, M, C, or K is added to the reference sign when there is a need to distinguish between them. In FIG. 2, reference signs are provided solely to the components of the image forming unit 41Y for the Y component and the reference signs of the components of the other image forming units 41M, 41C, 41K are omitted.

The image forming unit 41 includes an exposure apparatus 411, a developing apparatus 200, a photoconductive drum 413, a charging apparatus 414, and a drum cleaning apparatus 415.

The photoconductive drum 413 is a negative charge type organic photoconductor (OPC) formed, for example, with an under coat layer (UCL), a charge generation layer (CGL), a charge transport layer (CTL), sequentially laminated on a peripheral surface of an aluminum conductive cylindrical body (aluminum pipe).

The charging apparatus 414 uniformly charges the surface of the photoconductive drum 413 having photoconductivity to negative polarity by generating corona discharge.

The exposure apparatus 411 includes, for example, a semiconductor laser, and emits laser light corresponding to images of individual color components toward the photoconductive drum 413. A positive charge is generated in the charge generation layer of the photoconductive drum 413 and transported to the surface of the charge transport layer, whereby the surface charge (negative charge) of the photoconductive drum 413 is neutralized. An electrostatic latent image of each of the color components is formed on the surface of the photoconductive drum 413 due to a potential difference with the surroundings.

The developing apparatus 200 is a two-component reversal type developing apparatus and forms a toner image by visualizing the electrostatic latent image by adhering toner of each of the color components to the surface of the photoconductive drum 413. The developing apparatus 200 forms the toner image on the surface of the photoconductive drum 413 by feeding the toner contained in the developer to the photoconductive drum 413.

The drum cleaning apparatus 415 includes a drum cleaning blade that comes in sliding contact with the surface of the photoconductive drum 413, and removes transfer residual toner remaining on the surface of the photoconductive drum 413 after primary transfer.

The intermediate transfer unit 42 includes an intermediate transfer belt 421, a primary transfer roller 422, a plurality of support rollers 423, a secondary transfer roller 424, and a belt cleaning apparatus 426.

The intermediate transfer belt 421 is formed of an endless belt and stretched in a loop around a plurality of support rollers 423. At least one of the plurality of support rollers 423 is constituted with a driving roller, and the other is (are) constituted by a driven roller. The rotation of the driving roller allows the intermediate transfer belt 421 to run in a direction A at a constant speed. The intermediate transfer belt 421 is a belt having conductivity and elasticity, and is rotationally driven by a control signal from the controller 101.

The primary transfer roller 422 is arranged on an inner peripheral surface side of the intermediate transfer belt 421 so as to face the photoconductive drum 413 of each of the color components. The primary transfer roller 422 comes in pressing contact with the photoconductive drum 413 having the intermediate transfer belt 421 in between, thereby forming a primary transfer nip for transferring a toner image from the photoconductive drum 413 to the intermediate transfer belt 421.

The secondary transfer roller 424 is arranged on the outer peripheral surface side of the intermediate transfer belt 421 so as to face a backup roller 423B arranged on a downstream side in a belt running direction of the driving roller 423A. The secondary transfer roller 424 comes in pressing contact with the backup roller 423B having the intermediate transfer belt 421 in between, thereby forming a secondary transfer nip for transferring a toner image from the intermediate transfer belt 421 to the sheet S.

The belt cleaning apparatus 426 removes the transfer residual toner remaining on the surface of the intermediate transfer belt 421 after the secondary transfer.

When the intermediate transfer belt 421 passes through the primary transfer nip, the toner images on the photoconductive drum 413 are overlapped and primary-transferred sequentially onto the intermediate transfer belt 421. Specifically, a primary transfer bias is applied to the primary transfer roller 422, and a charge having a polarity opposite to the polarity of the toner is applied to the back side of the intermediate transfer belt 421, that is, the side coming in contact with the primary transfer roller 422, whereby the toner image is electrostatically transferred to the intermediate transfer belt 421.

Thereafter, when the sheet S passes through the secondary transfer nip, the toner image on the intermediate transfer belt 421 is secondary-transferred onto the sheet S. Specifically, a secondary transfer bias is applied to the backup roller 423B and a charge with the same polarity as the toner is provided to the front side of the sheet S, that is, the side that abuts the intermediate transfer belt 421, whereby the toner image is electrostatically transferred to the sheet S.

The fixing part 60 includes an upper fixing part 60A and a lower fixing part 60B. The upper fixing part 60A includes a fixing surface-side member arranged on a toner image formation-side surface of the sheet S, that is, a fixing surface of the sheet S. The lower fixing part 60B includes back side support member arranged on a side opposite to the fixing surface, that is, a back side of the sheet S. The back side support member comes in pressing contact with the fixing surface-side member, whereby a fixing nip for holding and conveying the sheet S is formed.

The fixing part 60 is configured to heat and pressurize, at the fixing nip, the conveyed sheet S on which the toner image is secondary-transferred, thereby fixing the toner image on the sheet S.

The upper fixing part 60A includes an endless fixing belt 61, a heating roller 62, and a fixing roller 63 which are fixing surface-side members. The fixing belt 61 is stretched by the heating roller 62 and the fixing roller 63.

The lower fixing part 60B includes a pressure roller 64 as the back side support member. The pressure roller 64 forms a fixing nip for conveying the sheet S by holding the sheet B between oneself and the fixing belt 61.

The sheet conveyer 50 includes a sheet feeder 51, a sheet discharger 52, a conveying path part 53. In the three sheet feeding tray units 51*a* to 51*c* constituting the sheet feeder 51, the sheet S (standard sheets and special sheets) identified on the basis of the grammage and size of the sheet S is contained being classified into each of preset types.

The conveying path part 53 has a plurality of conveying roller pairs such as a pair of registration rollers 53*a*. The sheets S contained in the sheet feeding tray units 51*a* to 51*c* are fed one by one from the uppermost portion and are conveyed to the image forming part 40 by the conveying path part 53. At this time, a registration roller part including a pair of registration rollers 53*a* corrects inclination of the fed sheet S and adjusts a conveyance timing. Subsequently, the toner image of the intermediate transfer belt 421 is collectively secondary-transferred onto one surface of the sheet S on the image forming part 40, and then, undergoes a fixing process on the fixing part 60. The sheet S on which an image has been formed is discharged to the outside of the apparatus by the sheet discharger 52 having a sheet discharging roller 52*a*.

Figure 4:
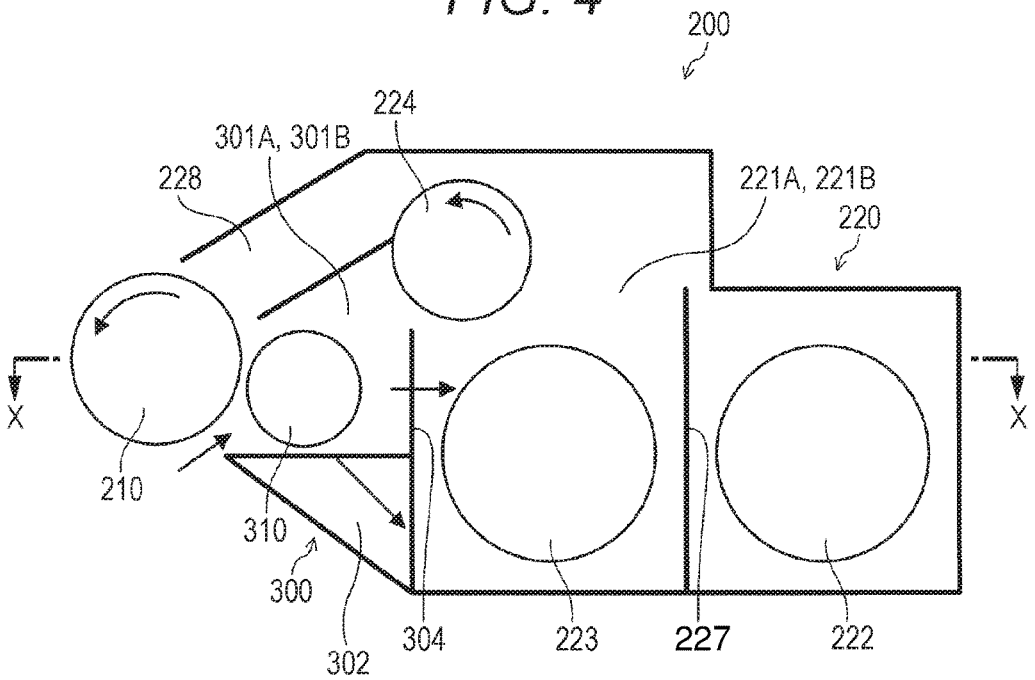
FIG. 4 is a simplified diagram illustrating a developing apparatus.
Figure 5:
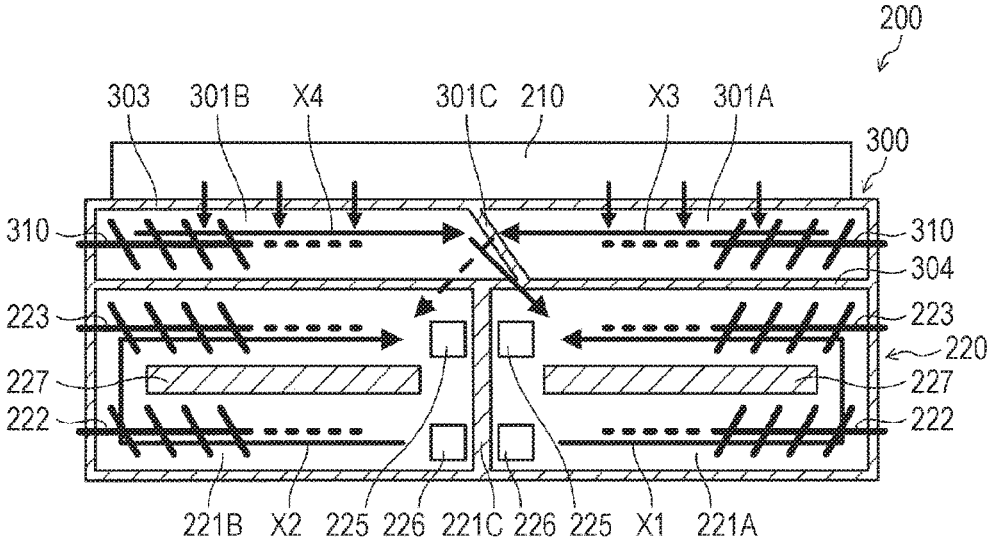
FIG. 5 is a sectional view of the developing apparatus in FIG. 4 taken along line X-X.

Next, details of the developing apparatus 200 will be described. FIG. 4 is a simplified diagram illustrating the developing apparatus 200. FIG. 5 is a sectional view of the developing apparatus 200 in FIG. 4 taken along line X-X.

As illustrated in FIGS. 4 and 5, the developing apparatus 200 has a size that can handle a long sheet in the axial direction such as B1 size, and includes a developing sleeve 210, a developer casing 220, and a collecting part 300. The developing sleeve 210 is a developer carrying member that carries the developer, and has a length corresponding to the sheet having a long length in the axial direction.

The developer casing 220 contains the developer to be fed to the developing sleeve 210. The developer casing 220 includes a central wall 221C dividing the first region 221A which is a region on one side with respect to a portion corresponding to a central portion in the axial direction of the developing sleeve 210, from the second region 221B as the region on the other side. Each of the first region 221A and the second region 221B in the developer casing 220 corresponds to a "developer feeder" of the present invention.

Each of the first region 221A and the second region 221B of the developer casing 220 includes a first stirring member 222, a second stirring member 223, a feeding member 224, a toner concentration detector 225, and a toner supplier 226.

The first stirring member 222 is provided in a portion farther from the developing sleeve 210 compared with the second stirring member 223, in each of the first region 221A and the second region 221B.

The second stirring member 223 is provided in a portion of the first region 221A and the second region 221B, facing the developing sleeve 210.

In each of the first region 221A and the second region 221B, the region of the first stirring member 222 and the region of the second stirring member 223 are divided from each other by a partition plate 227. The region of the first stirring member 222 and the region of the second stirring member 223 in the first region 221A and the second region 221B are divided by the partition plate 227, and thus are connected with each other at a portion corresponding to the ends of the first stirring member 222 and the second stirring member 223.

Accordingly, the rotation of the first stirring member 222 and the second stirring member 223 allows the developer to move so as to rotate around the partition plate 227 within the first region 221A and the second region 221B (refer to arrows X1 and X2) to eventually stir the developer in the first region 221A and the second region 221B.

The feeding member 224 is arranged above the second stirring member 223 and attracts the developer in the developer casing 220 by a magnetic force. The developer casing 220 includes a path 228 directing from the feeding member 224 to the developing sleeve 210, and the feeding member 224 feeds the developer to the developing sleeve 210 via the path 228.

The toner concentration detector 225 detects the concentration of the toner in the first region 221A and the second region 221B. The toner supplier 226 supplies toner to each of the first region 221A and the second region 221B. The controller 101 controls the toner supply amount in the toner supplier 226 on the basis of a result of detection by the toner concentration detector 225.

The collecting part 300 is a portion that collects the developer remaining on the developing sleeve 210 without being fed from the developing sleeve 210 to the photoconductive drum 413. The collecting part 300 is located below the path 228 and between a region in which the second stirring member 223 is located and the developing sleeve 210, in the developer casing 220.

The collecting part 300 includes a partition wall 301C dividing a first collecting region 301A which is a region on one side with respect to a central portion in the axial direction of the developing sleeve 210, from a second collecting region 301B as the region on the other side.

The first collecting region 301A is located at a position of the first region 221A in the developer casing 220 in the axial direction. The second collecting region 301B is located at a position of the second region 221B in the developer casing 220 in the axial direction.

At a portion below the first collecting region 301A and the second collecting region 301B, there is provided a feeding path 302 that feeds developer from the collecting part 300 to the developer casing 220. The feeding path 302 is a path that allows communication between the first collecting region 301A and the second region 221B of the developer casing 220.

Each of the first collecting region 301A and the second collecting region 301B in the collecting part 300 includes a conveying member 310. The conveying member 310 is a screw capable of stirring the developer in the collecting part 300, and conveys the developer from the end toward the central portion of the developing sleeve 210 in the axial direction (refer to arrows X3 and X4).

The partition wall 301C extends from a central portion of the wall 303 on the developing sleeve 210 side of the collecting part 300 to a position reaching the first region 221A over the central wall 221C in the boundary wall 304 between the collecting part 300 and the developer casing 220.

Figure 6:
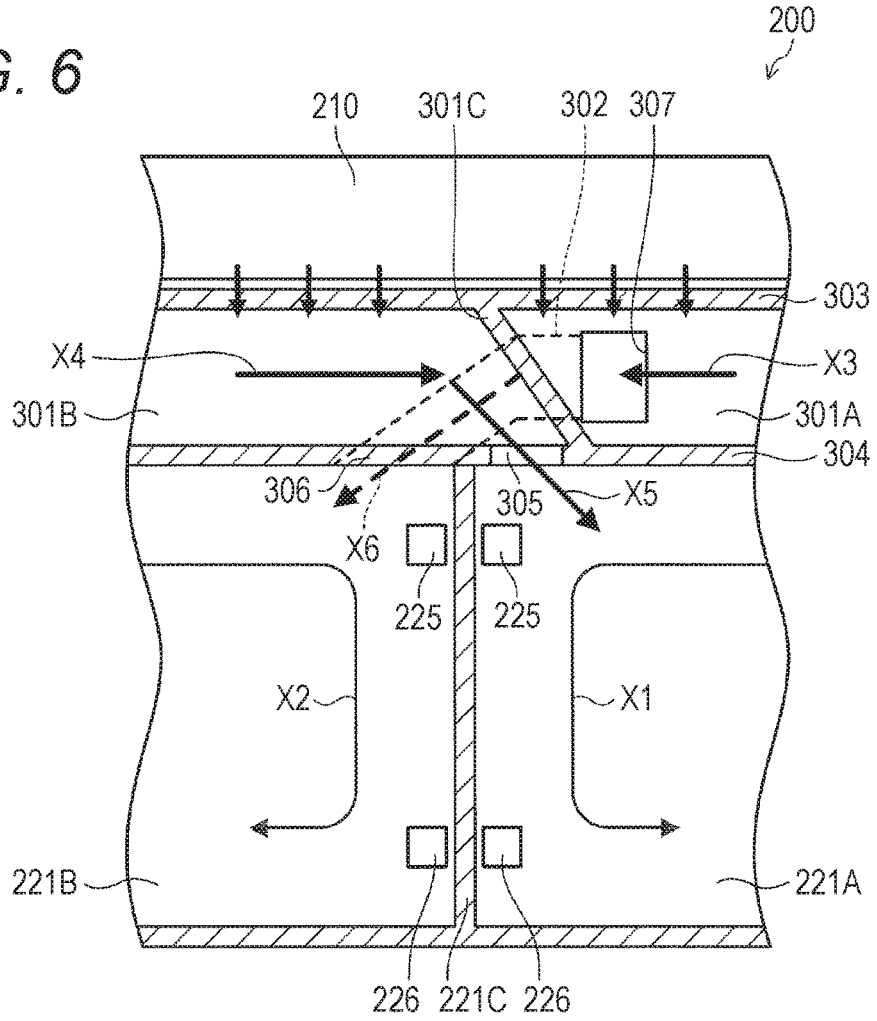
FIG. 6 is an enlarged view of the vicinity of a feeding port in the developing apparatus.

As illustrated in FIG. 6, the boundary wall 304 includes a first opening 305 formed between the partition wall 301C and the central wall 221C. The first opening 305 allows communication between the second collecting region 301B in the collecting part 300 and the first region 221A in the developer casing 220. The boundary wall 304 corresponds to a "boundary" of the present invention, and the first opening 305 corresponds to a "feeding port" of the present invention.

This configuration allows the developer collected in the second collecting region 301B to be conveyed to the central portion by the conveying member 310 so as to be fed to the first region 221A via the first opening 305. In other words, the developer fed to the developing sleeve 210 from the second region 221B is collected in the second collecting region 301B to be fed to the first region 221A (refer to arrow X5). In this case, the first region 221A corresponds to a "second developer feeder" of the present invention, and the second region 221B corresponds to a "first developer feeder" of the present invention.

The developer fed to the first region 221A merges with the flow of developer (arrow X1) in the first region 221A to be continually mixed with the developer in the first region 221A.

Moreover, a portion of the boundary wall 304 (refer to FIG. 4) in the feeding path 302 includes a second opening 306. The second opening 306 is located at a position of the second region 221B in the developer casing 220. The second opening 306 corresponds to the "feeding port" of the present invention.

Moreover, a bottom wall in the vicinity of the partition wall 301C in the first collecting region 301A includes a third opening 307 communicating with the feeding path 302.

This configuration allows the developer collected in the first collecting region 301A to be conveyed to the central portion by the conveying member 310 so as to be fed to the second region 221B via the third opening 307, the feeding path 302, and the second opening 306. In other words, the developer fed to the developing sleeve 210 from the first region 221A is collected in the first collecting region 301A to be fed to the second region 221B (refer to arrow X6). In this case, the second region 221B corresponds to a "second developer feeder" of the present invention, and the first region 221A corresponds to a "first developer feeder" of the present invention.

The developer fed to the second region 221B merges with the flow of developer (arrow X2) in the second region 221B to be continually mixed with the developer in the second region 221B.

Figure 7:
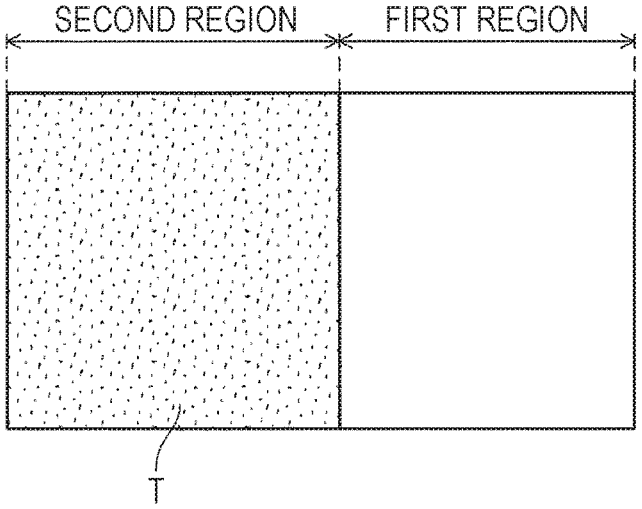
FIG. 7 is a diagram illustrating a sheet including a toner image having a large coverage difference between a portion corresponding to a first region and a portion corresponding to a second region.

Meanwhile, as illustrated in FIG. 7, in a case where a toner image T in which the amount of toner in the portion corresponding to the first region 221A is extremely smaller than the amount of toner in the portion corresponding to the second region 221B is successively formed with the configuration having no collecting part 300, for example, there would be an extremely large difference in the amount of developer used in the first region 221A and the second region 221B in the developer casing 220. This would generate a difference in the state of the developer between the first region 221A and the second region 221B in the developer casing 220, leading to a difference in image density.

In contrast, in the present embodiment, the developer fed to the developing sleeve 210 from the second region 221B is collected in the second collecting region 301B to be fed to the first region 221A. In addition, the developer fed to the developing sleeve 210 from the first region 221A is collected in the first collecting region 301A to be fed to the second region 221B.

In short, due to the presence of the collecting part 300, the developer is fed to the region different from the region located at the position where the developer is collected from the developing sleeve 210 in the axial direction. Therefore, even when the amount of developer used in the first region 221A and the second region 221B is extremely different from each other, it is possible to efficiently uniformize the state of the developer in the first region 221A and the second region 221B.

Moreover, it is possible to mix the developer in the first region 221A with the developer in the second region 221B in the developer casing 220 by a series of operation from feeding the developer to the developing sleeve 210 to collecting the developer from the developing sleeve 210, leading to achievement of uniformity in the state of the developer without performing complicated control.

Moreover, as illustrated in FIG. 6, according to the present embodiment, the toner concentration detector 225 is provided in the vicinity of the first opening 305 and the second opening 306, through which the developer is fed to the first region 221A and the second region 221B, respectively. The toner supplier 226 is provided on more downstream side than the toner concentration detector 225 in the direction of developer flow (refer to arrows X1 and X2).

In other words, the toner supplier 226 is located on more downstream side than the toner concentration detector 225 in a direction where the developer fed from the first opening 305 and the second opening 306 in the boundary wall 304 between the collecting part 300 and the developer casing 220 flows in the first region 221A and the second region 221B.

Moreover, the toner concentration detector 225 is arranged at a position capable of detecting the toner concentration after the developer fed from the first opening 305 or the second opening 306 is mixed with the developer in the first region 221A or the second region 221B, respectively.

With this arrangement, it is possible to detect toner concentration after the developer from the collecting part 300 is fed to the developer casing 220, and thereafter perform toner supply accordingly. As a result, toner supply can be performed appropriately.

Moreover, with the conveying member 310 provided in the collecting part 300, it is possible to efficiently convey the developer to the first opening 305 and the third opening 307 by the conveying member 310.

Note that while the above-described embodiment has a configuration of feeding the developer to the developing sleeve 210 using the feeding member 224, the present invention is not limited to this and a configuration without the feeding member 224 may be adopted.

Figure 8:
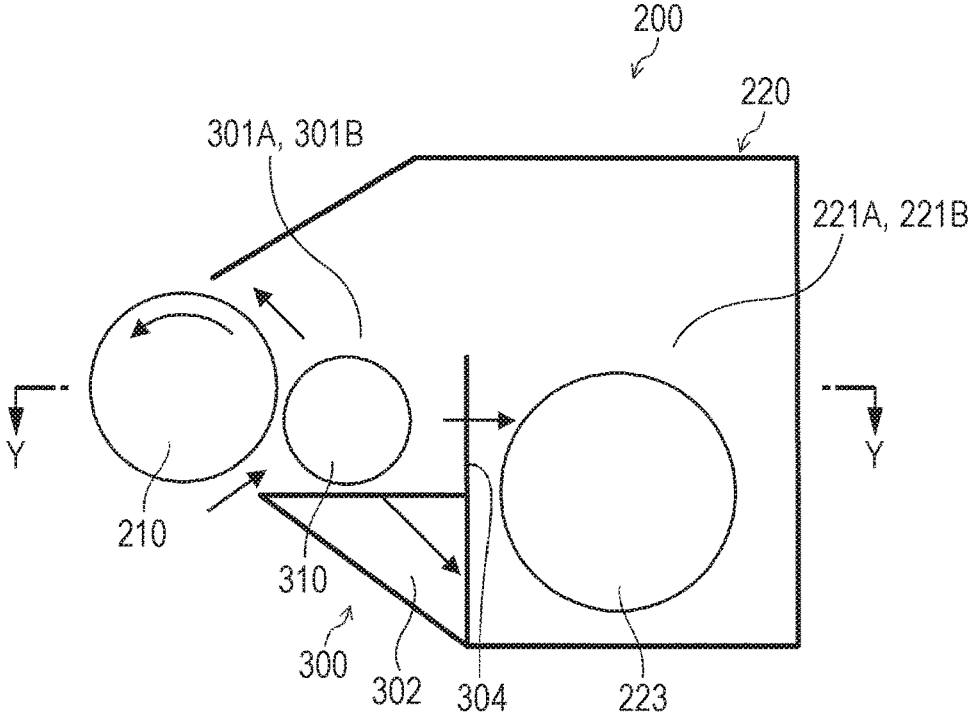
FIG. 8 is a simplified diagram illustrating a developing apparatus according to a modification.
Figure 9:
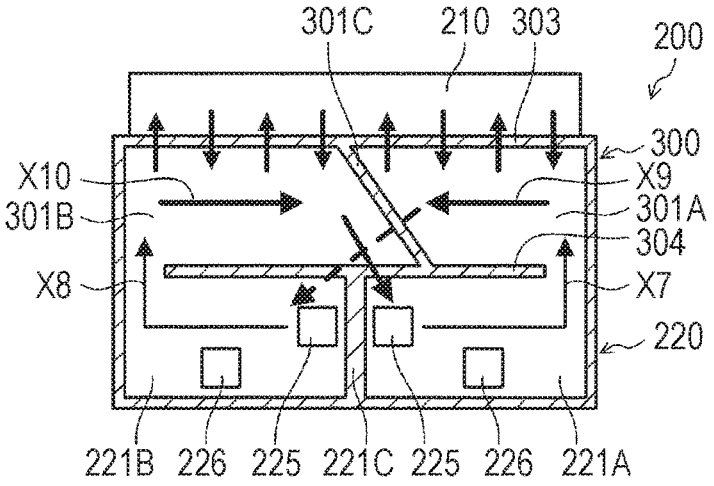
FIG. 9 is a Y-Y sectional view of the developing apparatus in FIG. 8.

As illustrated in FIGS. 8 and 9, the developing apparatus 200 in this configuration does not include a region to arrange the first stirring member 222 in the developer casing 220. While communicating at the first opening 305, the second opening 306, and the third opening 307, the collecting part 300 and the developer casing 220 communicate with each other at a portion of an end in the axial direction of the developer casing 220.

Specifically, the first region 221A and the first collecting region 301A communicate with each other at a right end in the axial direction of the boundary wall 304, while the second region 221B and the second collecting region 301B communicate with each other at a left end in the axial direction of the boundary wall 304. The second stirring member 223 conveys the developer from the center to the end in the axial direction (refer to arrows X7 and X8).

With this configuration, the developer is conveyed to the collecting part 300 by the second stirring member 223 at the communicating portion on the boundary wall 304, and is conveyed toward the central portion in the axial direction by the conveying member 310 (refer to arrows X9 and X10).

In this manner, the developer in the first collecting region 301A and the second collecting region 301B of the collecting part 300 is stirred in the developer casing 220 and the collecting part 300 by the conveying member 310 and the second stirring member 223.

While the developer in the first collecting region 301A and the second collecting region 301B is fed to the developing sleeve 210, the developer is collected from the developing sleeve 210 to the first collecting region 301A and the second collecting region 301B, so as to be conveyed to the central portion and fed to any of the first region 221A and the second region 221B.

With this configuration in which the conveying member 310 stirs the developer in the developer casing 220 and the collecting part 300, it is possible to reduce one stirring member in the developing apparatus 200, leading to downsizing of the entire apparatus.

While the above-described embodiment illustrates a case where the plurality of regions (the first region 221A and the second region 221B) in the single developer casing 220 is provided as a developer feeder, the present invention is not limited to this, and the individual regions of the plurality of casings may be provided as the developer feeders.

Moreover, while the above-described embodiment has a configuration in which the developer casing 220 includes the two regions (the first region 221A and the second region 221B), the present invention is not limited to this configuration. For example, the developer casing 220 may include three or more regions (developer feeder).

For example, in the case of a developer casing having three regions aligned in the axial direction (first region, second region, and third region), the collecting part includes the first collecting region corresponding to the first region, the second collecting region corresponding to the second region, and the third collecting region corresponding to the third region. As a method of feeding the developer from the collecting part to the developer casing, it is possible to have a configuration in which the developer is fed from the first collecting region to the second region, from the second collecting region to the third region, and from the third collecting region to the first region.

Furthermore, any of the above-described embodiments merely illustrates an exemplary embodiment of the present invention, and thus, the technical scope of the present invention should not be limited in interpretation thereof. That is, the present invention can be implemented in various forms without departing from the spirit or the main features thereof.

Finally, an evaluation experiment of the developing apparatus 200 according to an embodiment of the present embodiment will be described.

The effectiveness of the present invention was confirmed using the developing apparatus 200 illustrated in FIG. 4. Specifically, the effectiveness of the present invention was confirming by checking the percentage of unused carriers in the developer casing 220 using an image having a difference in the amount of toner between the first region 221A and the second region 221B illustrated in FIG. 7. In addition, a similar experiment was performed using a comparative example of a developing apparatus without the collecting part 300, that is, an exemplary configuration in which the developer is directly collected from the developing sleeve 210 to the developer casing 220.

Figure 10:
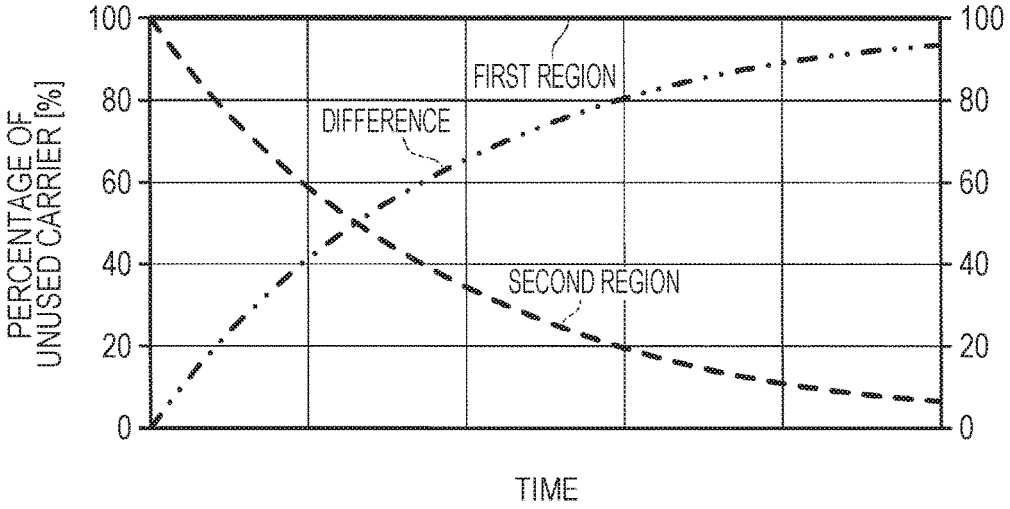
FIG. 10 is a diagram illustrating the percentage of a carrier with respect to the time in a comparative example.
Figure 11:
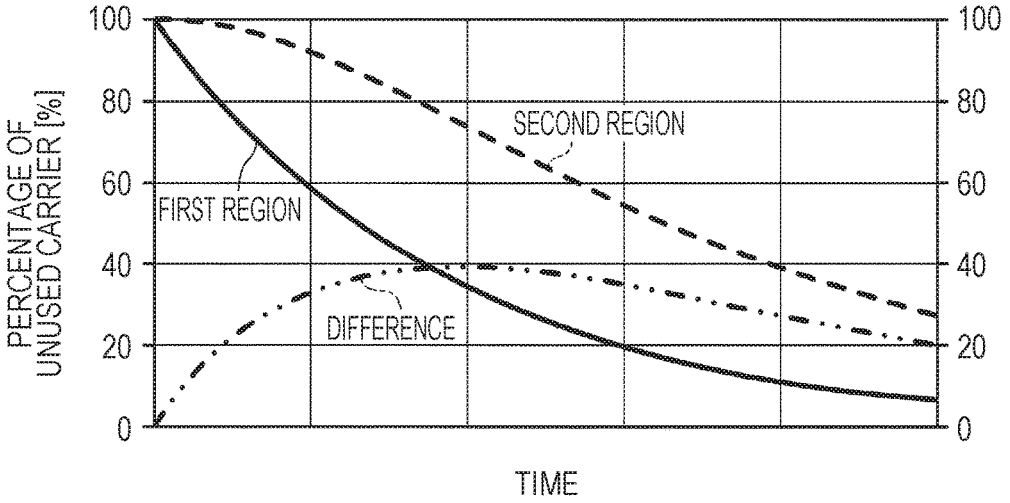
FIG. 11 is a diagram illustrating the percentage of the carrier with respect to the time.

FIG. 10 is a diagram illustrating the percentage of unused carriers with respect to the time in the comparative example. FIG. 11 is a diagram illustrating the percentage of unused carriers with respect to the time in the present embodiment.

As illustrated in FIG. 10, in the case of the comparative example, the developer is not consumed in the first region 221A, that is, the carrier is not consumed, and thus, the percentage of unused carriers remains 100%. Accordingly, the developer in the first region 221A of the developer casing 220 does not deteriorate at all.

In contrast, a large amount of developer is used for the second region 221B, decreasing the percentage of unused carriers with the lapse of time. This leads to an increased developer deterioration amount in the second region 221B in the developer casing 220.

The difference in the percentage of unused carriers between the first region 221A and the second region 221B increases with the lapse of time, leading to an increased image density difference in the individual regions.

In contrast, the developing apparatus 200 according to the present embodiment is configured such that the developer in the first region 221A and the second region 221B is collected from the developing sleeve 210 to the collecting part 300. Subsequently, the developer collected in the second collecting region 301B is fed to the first region 221A, while the developer collected in the first collecting region 301A is fed to the second region 221B.

With this configuration, as illustrated in FIG. 11, the percentage of unused carriers declines with the lapse of time in both the first region 221A and the second region 221B. Accordingly, the difference between the percentage of unused carriers in the first region 221A and the second region 221B increases up to around 40% at the maximum, and thereafter gradually decreases. From this, it is possible to confirm that there is substantially no difference in developer in the individual regions, making it possible to ensure the effectiveness of the present invention.

Although embodiments of the present invention have been described and illustrated in detail, the disclosed embodiments are made for purposes of illustration and example only and not limitation. The scope of the present invention should be interpreted by terms of the appended claims.

What is claimed is:

1. A developing apparatus comprising:

a developer carrying member carrying a developer;

a plurality of developer feeders accommodating the developer carried by the developer carrying member, the plurality of developer feeders being arranged in an axial direction of the developer carrying member and comprising a first developer feeder on one side and a second developer feeder on the other side of a predetermined position of the developer carrying member; and a collecting part that collects the developer from the developer carrying member, the collecting part comprising a first collecting region positioned on the first developer feeder side and a second collecting region positioned on the second developer feeder side in the axial direction of the developer carrying member, wherein the collecting part supplies the developer collected in the first collecting region to the second developer feeder, and supplies the developer collected in the second collecting region to the first developer feeder.

2. The developing apparatus according to claim 1, wherein a feeding port through which the developer is fed from the collecting part to the developer feeder is formed at a boundary between the collecting part and the developer feeder, the developing apparatus further comprising:

a toner concentration detector provided in each of the plurality of developer feeders so as to detect a toner concentration in each of the developer feeders; and a toner supplier provided in each of the plurality of developer feeders so as to supply a toner to each of the developer feeders, the toner concentration detector is arranged at a position capable of detecting a concentration of the developer resulted from a mixture of the developer fed from the feeding port and the developer within the developer feeder, and the toner supplier is located more downstream side than the toner concentration detector in a direction of flow of the developer fed from the feeding port, within the developer feeder.

3. The developing apparatus according to claim 2, further comprising a conveying member provided in the collecting part so as to convey the developer toward the feeding port.

4. The developing apparatus according to claim 3, wherein the conveying member stirs the developer in the collecting part.

5. An image forming apparatus comprising:

a developer carrying member carrying a developer;

a plurality of developer feeders accommodating the developer carried by the developer carrying member, the plurality of developer feeders being arranged in an axial direction of the developer carrying member and comprising a first developer feeder on one side and a second developer feeder on other side of a predetermined position of the developer carrying member; and a collecting part that collects the developer from the developer carrying member, the collecting part comprising a first collecting region positioned on the first developer feeder side and a second collecting region positioned on the second developer feeder side in the axial direction of the developer carrying member, wherein the collecting part supplies the developer collected in the first collecting region to the second developer feeder, and supplies the developer collected in the second collecting region to the first developer feeder.

* * * * *